US009120340B2

(12) United States Patent
Ishikawa et al.

(10) Patent No.: US 9,120,340 B2
(45) Date of Patent: Sep. 1, 2015

(54) PRINTER INCLUDING PRESENTER PART AND CUTTER PART THAT MOVE TOGETHER

(71) Applicant: FUJITSU COMPONENT LIMITED, Tokyo (JP)

(72) Inventors: Tetsuhiro Ishikawa, Tokyo (JP); Sumio Watanabe, Tokyo (JP); Masahiro Tsuchiya, Tokyo (JP); Tatsuya Oguchi, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/061,872

(22) Filed: Oct. 24, 2013

(65) Prior Publication Data

US 2014/0119806 A1 May 1, 2014

(30) Foreign Application Priority Data

Oct. 31, 2012 (JP) ..... 2012-241054

(51) Int. Cl.

| | |
|---|---|
| ***B41J 29/02*** | (2006.01) |
| ***B41J 13/10*** | (2006.01) |
| ***B41J 11/00*** | (2006.01) |
| ***B41J 11/70*** | (2006.01) |
| ***B26D 1/08*** | (2006.01) |
| ***B26D 5/02*** | (2006.01) |
| ***B26D 5/08*** | (2006.01) |
| *B41J 15/04* | (2006.01) |

(52) U.S. Cl.

CPC ..... *B41J 13/106* (2013.01); *B26D 1/085* (2013.01); *B26D 5/02* (2013.01); *B26D 5/083* (2013.01); *B41J 11/006* (2013.01); *B41J 11/70* (2013.01); *B41J 15/042* (2013.01); *B41J 29/02* (2013.01)

(58) Field of Classification Search

USPC ..... 400/621

See application file for complete search history.

(56) References Cited

U.S. PATENT DOCUMENTS

| | | | | |
|---|---|---|---|---|
| 4,663,638 | A * | 5/1987 | Hirose | 400/613 |
| 5,749,277 | A * | 5/1998 | Walker | 83/563 |
| 5,820,068 | A * | 10/1998 | Hosomi et al. | 242/563 |
| 6,428,226 | B1 | 8/2002 | Suzuki et al. | |
| 6,443,645 | B1 * | 9/2002 | Takei et al. | 400/691 |
| 6,504,331 | B1 * | 1/2003 | Longrod | 318/280 |
| 6,508,600 | B1 | 1/2003 | Nonaka | |
| 6,814,515 | B2 | 11/2004 | Tsuchiya et al. | |
| 7,857,534 | B2 * | 12/2010 | Watanabe et al. | 400/691 |
| 2004/0037606 | A1 | 2/2004 | Tsuchiya et al. | |
| 2011/0198802 | A1 | 8/2011 | Tozaki | |
| 2012/0057918 | A1 | 3/2012 | Eoka | |

FOREIGN PATENT DOCUMENTS

| | | |
|---|---|---|
| JP | 2003-019845 | 1/2003 |
| JP | 2007-130842 | 5/2007 |

* cited by examiner

*Primary Examiner* — Jill Culler

(74) *Attorney, Agent, or Firm* — IPUSA, PLLC

(57) ABSTRACT

A printer includes a printing part, a cutter part, and a presenter part. The printing part performs printing on a recording medium. The cutter part cuts the recording medium subjected to the printing. The cutter part is attached to the printing part so as to be rotatable about a rotation shaft. The presenter part conveys the recording medium subjected to the printing in the printing part through the cutter part. The presenter part moves together with the cutter part in the case of rotating the cutter part about the rotation shaft.

12 Claims, 13 Drawing Sheets

PRINTER INCLUDING PRESENTER PART AND CUTTER PART THAT MOVE TOGETHER

CROSS-REFERENCE TO RELATED APPLICATION

The present application is based upon and claims the benefit of priority of Japanese Patent Application No. 2012-241054, filed on Oct. 31, 2012, the entire contents of which are incorporated herein by reference.

BACKGROUND OF THE INVENTION

1. Field of the Invention

The present invention relates to printers.

2. Description of the Related Art

Printers that output paper slips such as receipts are used for a wide variety of purposes, such as for registers in shops and automated teller machines (ATMs) or cash dispensers (CDs) in banks. In such printers that output receipts or the like, printing is performed on thermal paper, serving as recording paper, using a thermal head or the like while conveying the thermal paper, and after conveying the recording paper a predetermined length, the recording paper is cut with a cutter to the predetermined length.

Some of these printers that output receipts or the like include a presenter for conveying recording paper cut by the cutter. As a result of providing such a presenter, recording paper subjected to printing enters the presenter to be cut and discharged through the presenter. The recording paper subjected to printing thus discharged is pulled out.

In addition to a function as a presenter, some presenters have a retractor function to collect recording paper subjected to printing, in order to prevent discharged recording paper, that is, a printed receipt or the like, from being taken away by others when the discharged recording paper is left behind.

For related art, reference may be made to Japanese Laid-Open Patent Application No. 2003-19845 and Japanese Laid-Open Patent Application No. 2007-130842.

SUMMARY OF THE INVENTION

According to an aspect of the present invention, a printer includes a printing part configured to perform printing on a recording medium; a cutter part configured to cut the recording medium subjected to the printing, wherein the cutter part is attached to the printing part so as to be rotatable about a rotation shaft; and a presenter part configured to convey the recording medium subjected to the printing in the printing part through the cutter part, wherein the presenter part is configured to move together with the cutter part in a case of rotating the cutter part about the rotation shaft.

According to an aspect of the present invention, a printer includes a printing part configured to perform printing on a recording medium; a cutter part rotatably supported on the printing part by a rotation shaft, wherein the cutter part includes a cutter configured to cut the recording medium subjected to the printing by the printing part; and a presenter part configured to convey the recording medium conveyed through the cutter part, wherein the cutter part and the presenter part are formed as a unit, and the cutter part rotates to open a conveyance path between the printing part and the cutter part.

DESCRIPTION OF THE EMBODIMENTS

In printers, a presenter is commonly provided subsequent to a cutter. In such printers, when there is a jam of recording paper, both of the presenter and the cutter may have to be moved to remove the jammed recording paper.

Figure 1:
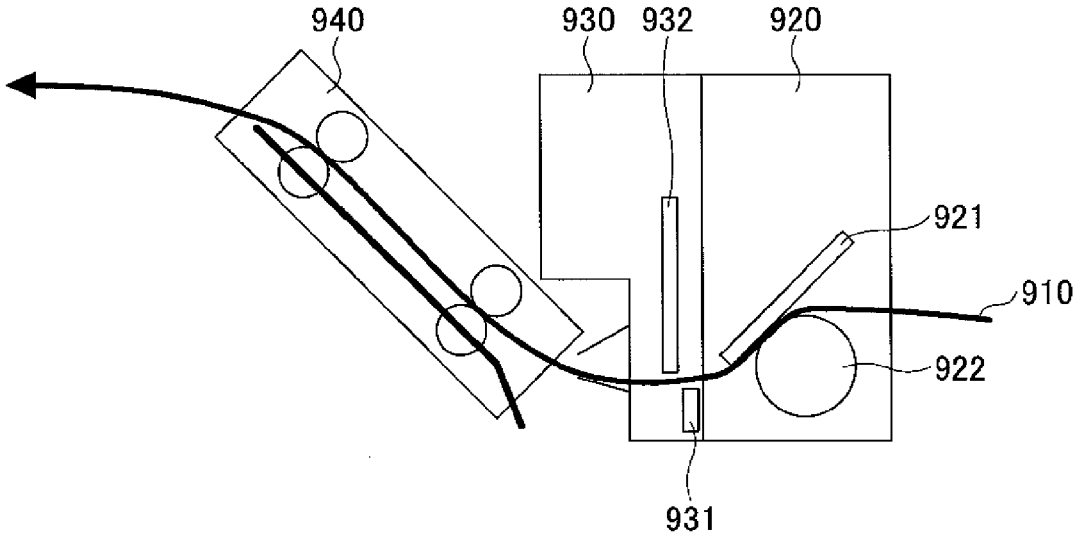
FIG.1 RELATED ART
FIG. 1 is a diagram illustrating a printer of related art.

For example, in the case of a printer as illustrated in FIG. 1, recording paper 910 is subjected to printing in a printing part 920 including a thermal head 921 and a platen roller 922, and passes between a fixed blade 931 and a movable blade 932 provided in a cutter part 930 to enter a presenter part 940 to be conveyed. While in the presenter 940, the recording paper 910 is cut to a predetermined length by the fixed blade 931 and the movable blade 932 provided in the cutter part 930.

In a printer where the cutter part 930 and the presenter part 940 are separated as illustrated in FIG. 1, when the recording paper 910 is jammed in the cutter part 930, the jammed recording paper 910 may be removed by moving the cutter part 930. Furthermore, when the recording paper 910 is jammed in the presenter part 940, the jammed recording paper 910 may be removed by moving the presenter part 940.

Figure 2A:
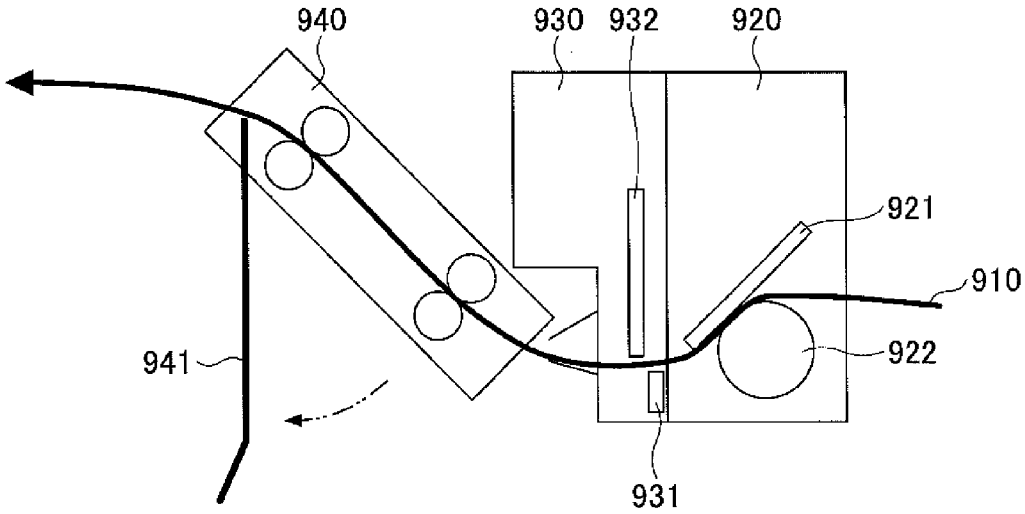
FIG.2A RELATED ART
FIGS. 2A and 2B are diagrams illustrating the printer of related art.
Figure 2B:
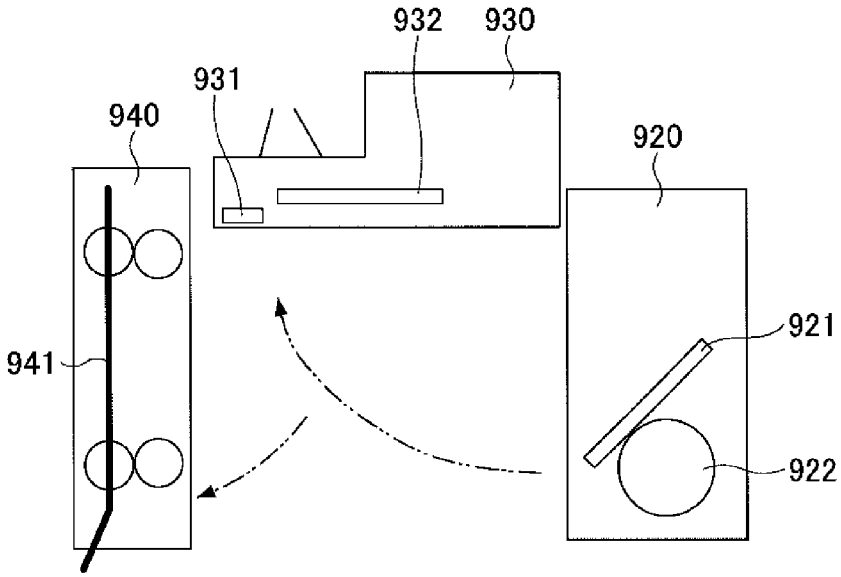
FIG.2B RELATED ART

Because of a general demand for smaller printers, the cutter part 930 and the presenter part 940 are disposed at positions close to each other. Therefore, in a printer having the structure illustrated in FIG. 1, when the recording paper 910 is jammed in the presenter part 940, the jammed recording paper 910 may be removed by opening an opening and closing part 941 of the presenter part 940 as illustrated in FIG. 2A. On the other hand, when the recording paper 910 is jammed in the cutter part 930, the cutter part 930 is moved after ensuring a space for moving the cutter part 930 by moving the entire presenter part 940 as illustrated in FIG. 2B. Therefore, both of the presenter part 940 and the cutter part 930 are moved. Moving both of the cutter part 930 and the presenter part 940 may take time and effort in removing jammed recording paper.

According to an aspect of the present invention, a printer that enables quick and easy removal of recording paper jammed in a presenter part or a cutter part is provided.

Embodiments of the present invention are described below. In the following description, the same elements as those previously described are referred to by the same reference numerals, and their description is omitted.

[a] First Embodiment

Figure 3:
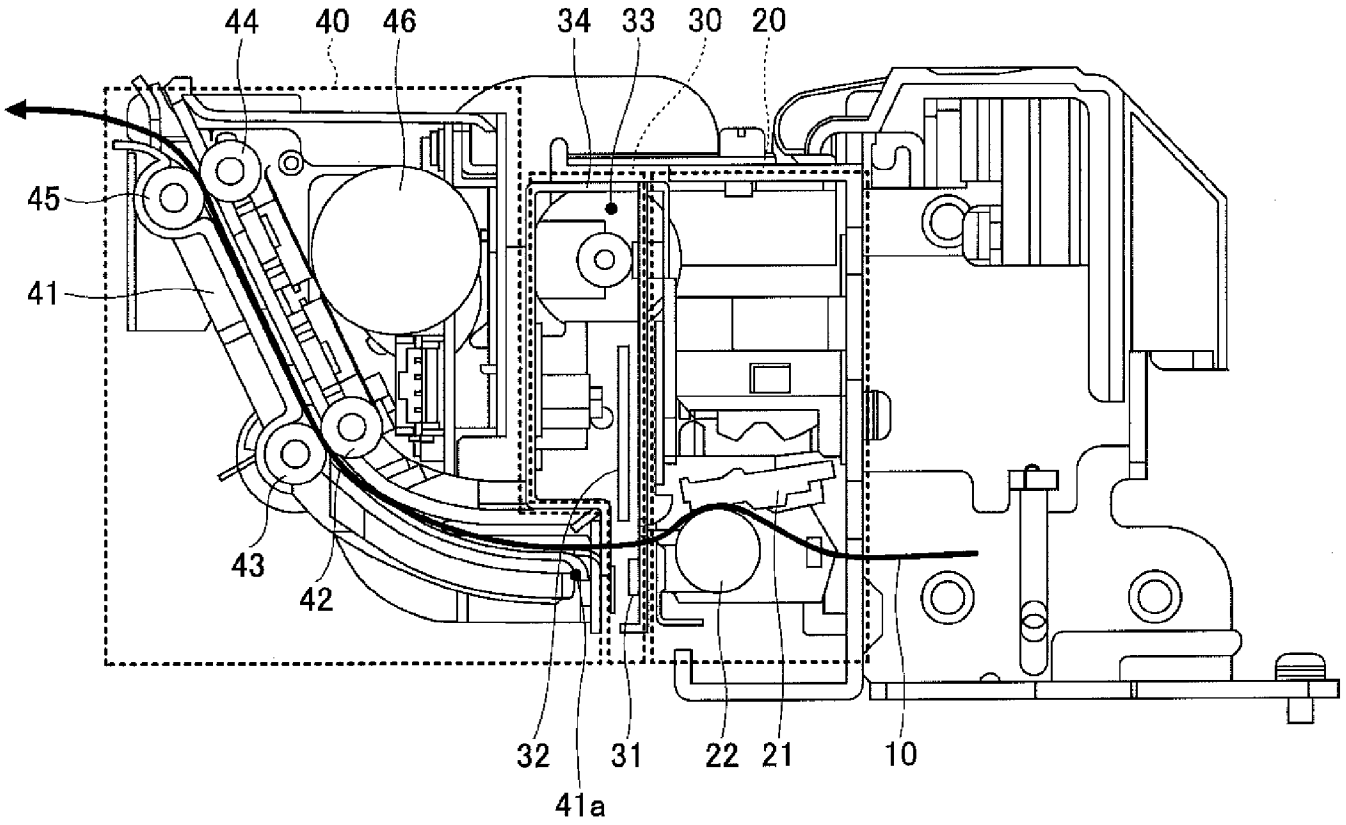
FIG. 3 is a diagram illustrating a configuration of a printer according to a first embodiment.

A printer according to a first embodiment is described. As illustrated in FIG. 3, a printer according to this embodiment includes a printing part 20 configured to perform printing on recording paper 10, which is an example of a recording medium, a cutter part 30 configured to cut the recording paper 10, and a presenter part 40 that has functions including a presenter function.

The printing part 20 includes a thermal head 21 and a platen roller 22. The thermal head 21 performs printing on the recording paper 10 held between the thermal head 21 and the platen roller 22. The recording paper 10 is output with a print surface of the recording paper facing upward. Therefore, the thermal head 21 is provided at a position higher than the recording paper 10.

The cutter part 30 includes a fixed blade 31 and a movable blade 32 for cutting the recording paper 10 subjected to printing by the thermal head 21. The recording paper 10 subjected to printing, passed between the fixed blade 31 and the movable blade 32, may be cut to a predetermined length by the fixed blade 31 and the movable blade 32. The cutter part 30 is attached to a main body of the printer including the printing part 20 in such a manner as to be rotatable about a first rotation shaft 33. Furthermore, the cutter part 30 includes a motor 34 for vertically driving the movable blade 32.

The presenter part 40 is provided on the downstream side of the cutter part 30 in a direction in which the recording paper 10 is conveyed, and has a function of conveying the recording paper 10. The presenter part 40 includes a conveyance path cover 41. The conveyance cover 41 is rotatably connected to a second rotation shaft 41*a*. The presenter part 40 may be opened or closed by rotating the conveyance path cover 41 about the second rotation shaft 41*a*. Furthermore, the presenter part 40 includes rollers 42, 43, 44 and 45 for conveying the recording paper 10. The recording paper 10 subjected to printing may be conveyed by causing the rollers 42, 43, 44 and 45 to rotate in a predetermined direction by a motor 46. In this embodiment, the rollers 43 and 45 are provided on the conveyance path cover 41, and the recording paper 10 is conveyed between the rollers 42 and 43 and between the rollers 44 and 45.

Figure 4:
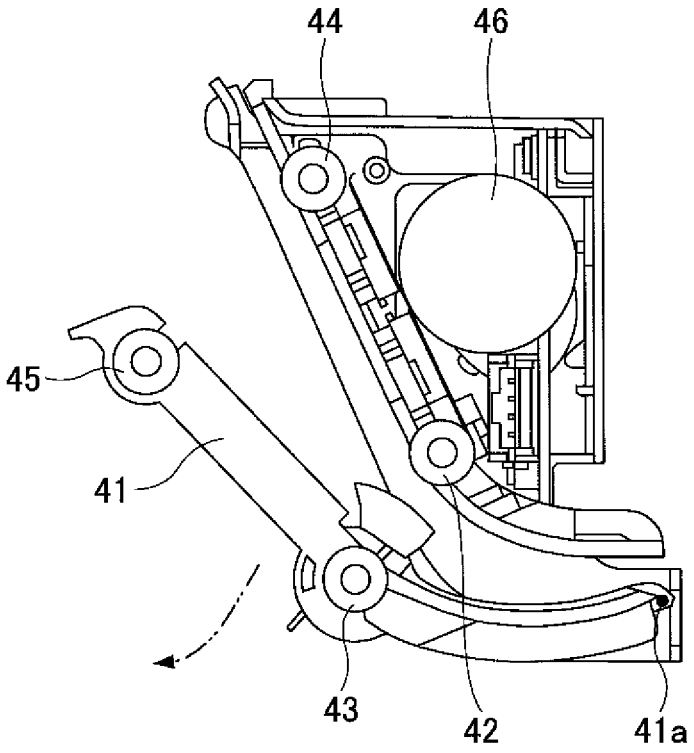
FIG. 4 is a diagram illustrating the printer according to the first embodiment.

In this embodiment, when the recording paper 10 is jammed in the presenter part 40, the recording paper 10 jammed inside the presenter part 40 may be removed by rotating the conveyance path cover 41 about the second rotation shaft 41*a* and opening the presenter part 40 as illustrated in FIG. 4. In this embodiment, when it is said that recording paper is jammed, this means a condition where recording paper is jammed and not conveyable, for example, a condition where recording paper is jammed and "crumpled" so that it is impossible to convey the recording paper.

Figure 5:
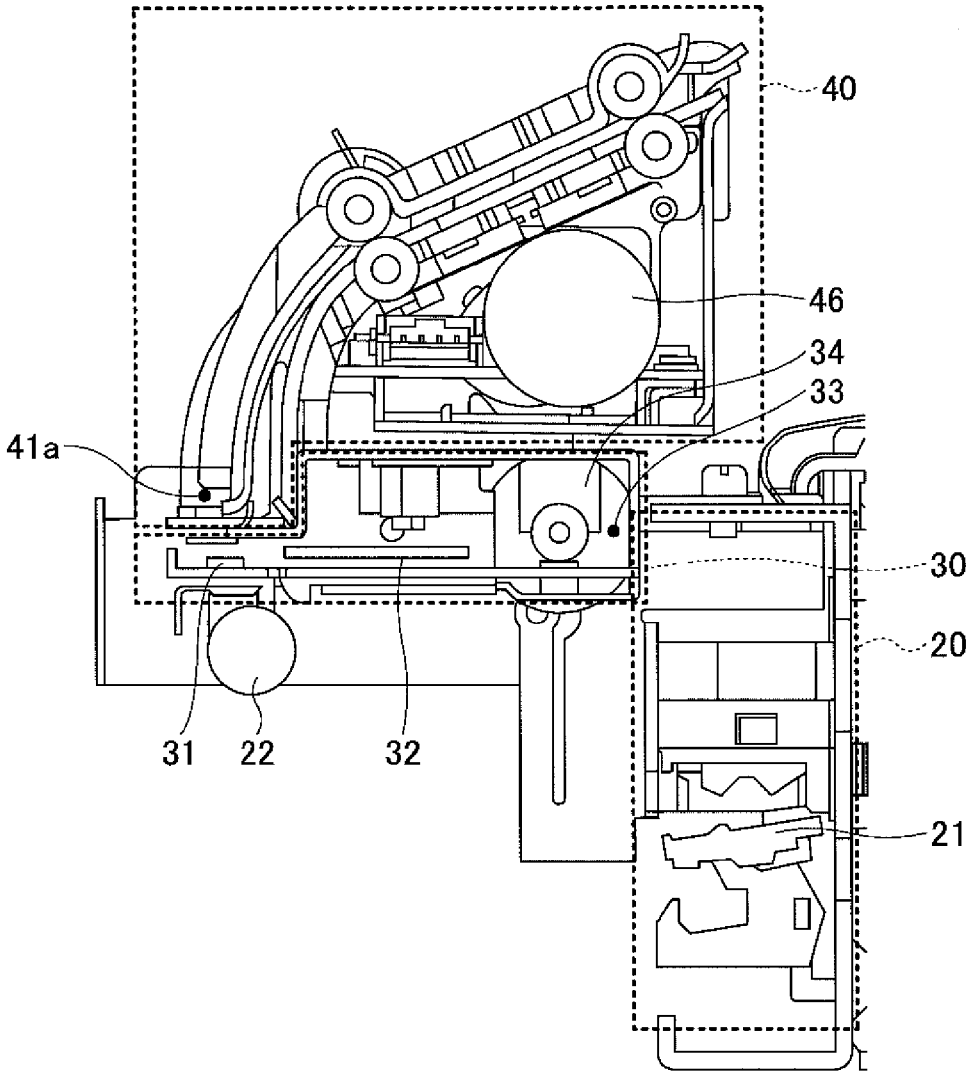
FIG. 5 is a diagram illustrating the printer according to the first embodiment.

Furthermore, when the recording paper 10 is jammed in the cutter part 30, the cutter part 30 may be opened relative to the thermal head 21 by rotating the cutter part 30 and the presenter part 40 as a unit about the first rotation shaft 33 as illustrated in FIG. 5. As a result, it is possible to remove the recording paper 10 jammed in the cutter part 30.

Thus, according to the printer of this embodiment, when the recording paper 10 is jammed in the presenter part 40, the recording paper 10 jammed inside the presenter part 40 may be removed by opening the conveyance path cover 41 in the presenter part 40 by rotating the conveyance path cover 41 about the second rotation shaft 41*a*. Furthermore, when the recording paper 10 is jammed in the cutter part 30, the jammed recording paper 10 may be removed by opening the cutter part 30 relative to the thermal head 21 by rotating the cutter part 30 and the presenter part 40 together about the first rotation shaft 33 in the cutter part 30. Therefore, it is possible to remove the jammed recording paper 10 in a single opening and closing operation in each of the case where the recording paper 10 is jammed in the presenter part 40 and the case where the recording paper 10 is jammed in the cutter part 30. Accordingly, it is possible to easily remove the jammed recording paper 10 in a short time.

Figure 6:
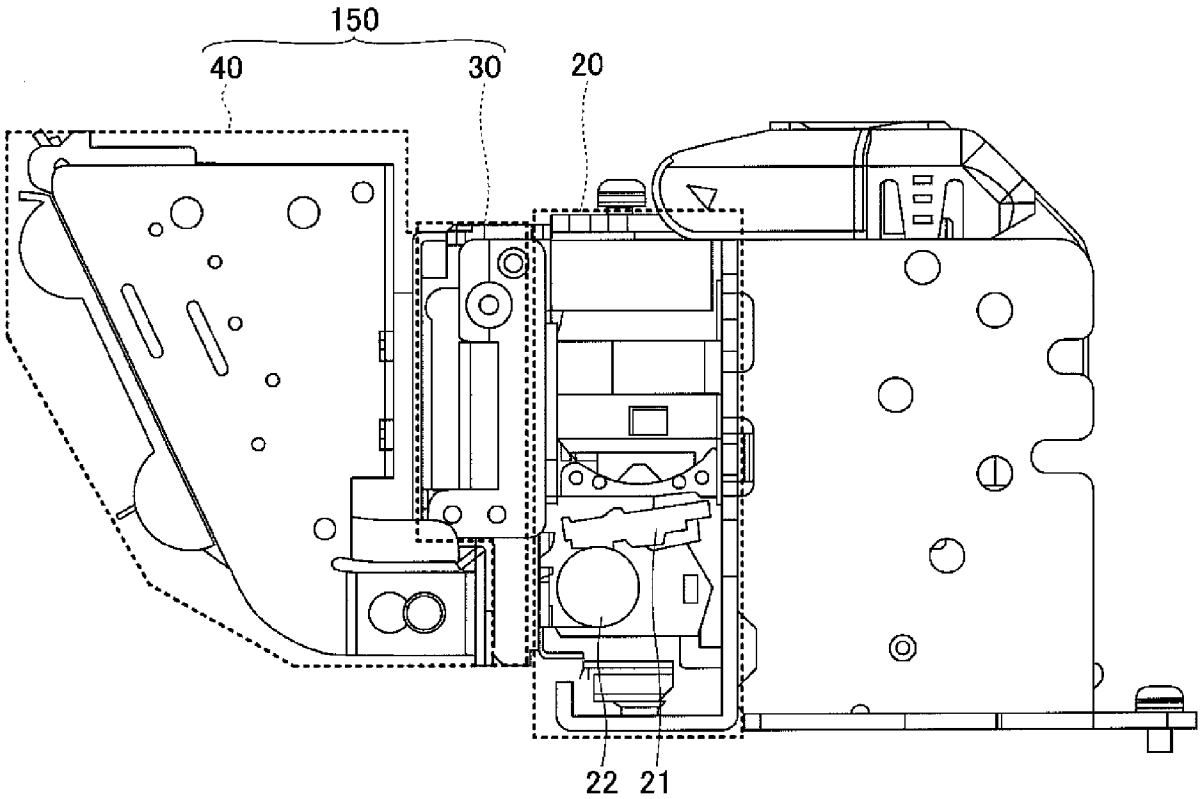
FIG. 6 is a diagram illustrating a configuration of another printer according to the first embodiment.

Furthermore, according to the printer of this embodiment, the cutter part 30 and the presenter part 40 may be unitarily connected and provided as a cutter unit 150 as illustrated in FIG. 6. Providing the cutter unit 150 as described above makes it possible to efficiently perform maintenance because the cutter part 30 and the presenter part 40 may be replaced in a single operation at the time of simultaneously replacing the cutter part 30 and the presenter part 40 for purposes such as maintenance.

[b] Second Embodiment

Figure 7:
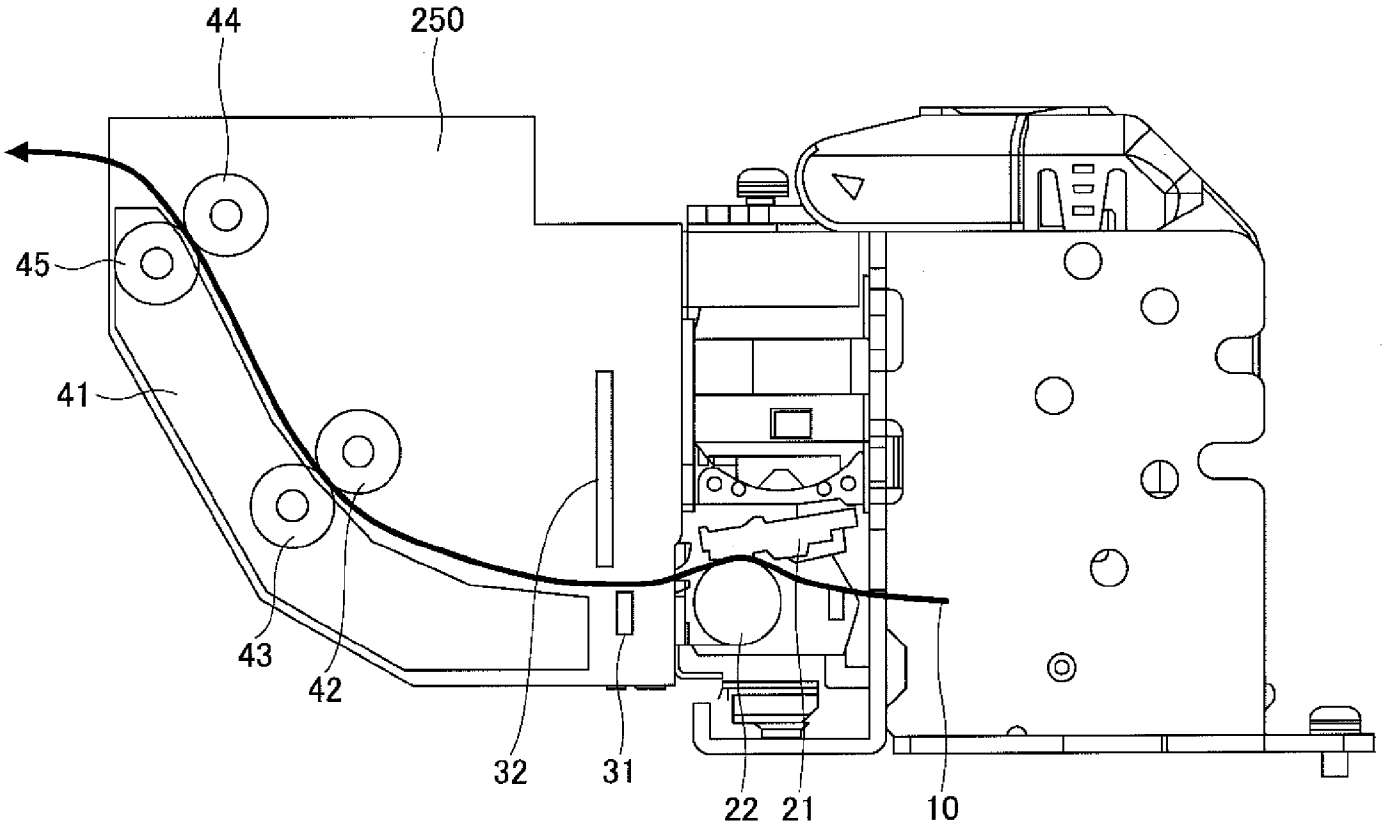
FIG. 7 is a diagram illustrating a configuration of a printer according to a second embodiment.

Next, a second embodiment is described. As illustrated in FIG. 7, a printer according to this embodiment includes a cutter unit 250, into which the cutter part and the presenter part in the first embodiment are unitarily formed. The cutter unit 250 includes the fixed blade 31 and the movable blade 32 for cutting the recording paper 10. The fixed blade 31 and the movable blade 32 are provided on the side on which the thermal head 21 and the platen roller 22 are provided. The cutter unit 250 further includes the rollers 42, 43, 44 and 45 for conveying the recording paper 10 and the conveyance path cover 41. The printer according to this embodiment also includes a motor, which is not illustrated in FIG. 7.

According to the printer of this embodiment, when the recording paper 10 is jammed near part of the cutter unit 250 where the rollers 42, 43, 44 and 45 are provided, the jammed recording paper 10 may be removed by opening the conveyance path cover 41 in the same manner as in the first embodiment. Furthermore, when the recording paper 10 is jammed near part of the cutter unit 250 where the fixed blade 31 and the movable blade 32 are provided, the jammed recording paper 10 may be removed by moving the cutter unit 250.

Figure 8:
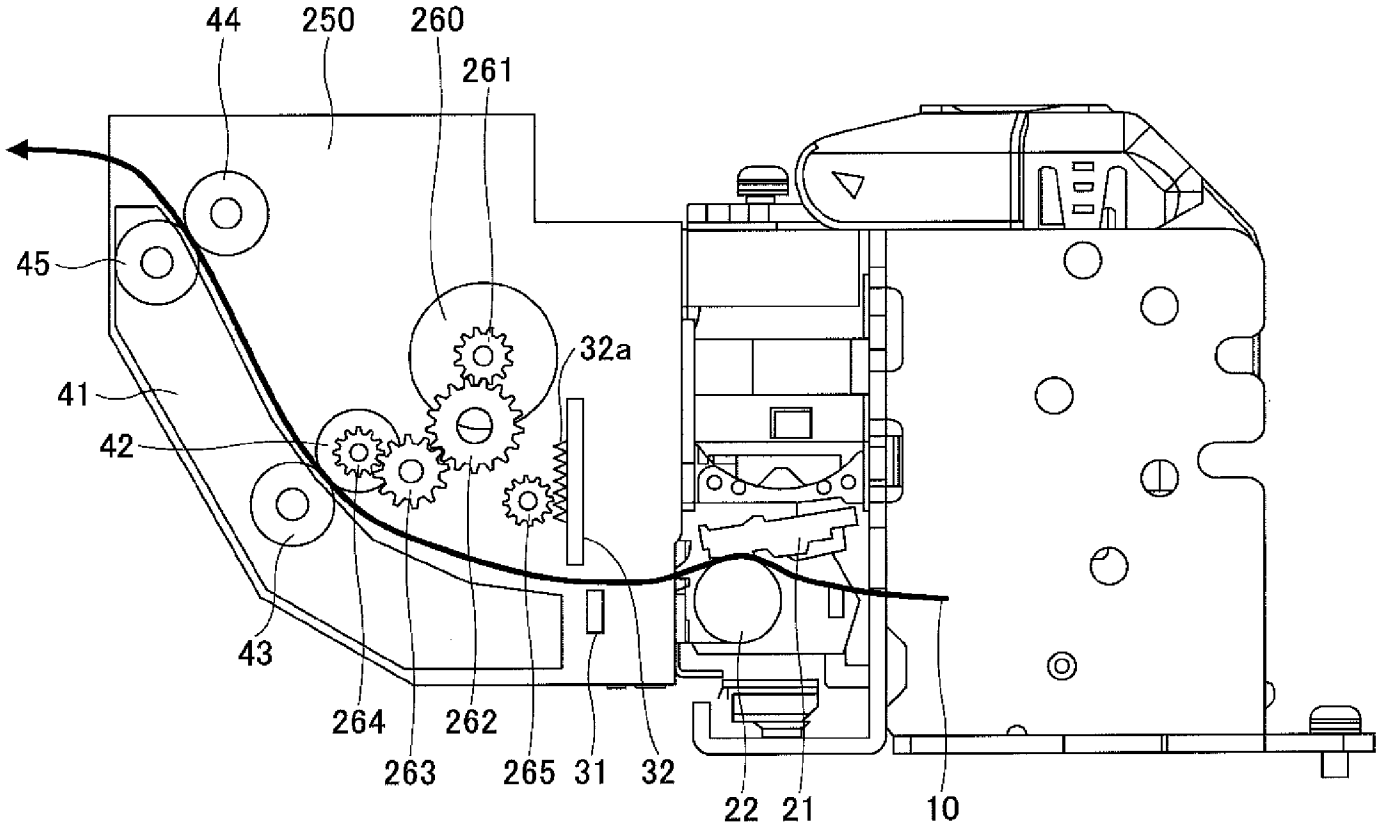
FIG. 8 is a diagram illustrating the printer according to the second embodiment.

Furthermore, according to the printer of this embodiment, the movable blade 32 and the rollers 42 and 44 may be driven by a single motor 260 as illustrated in FIG. 8. In printers provided with a thermal head, a cutter part and a presenter part are commonly separated, so that two motors, a motor for driving a movable blade in the cutter part and a motor for driving rollers in the presenter part, are provided.

According to the printer of this embodiment, the cutter unit 250 includes the fixed blade 31 and the movable blade 32 for cutting the recording paper 10 and the rollers 42, 43, 44 and 45 for conveying the recording paper 10. The movable blade 32 and the rollers 42 and 44 may be driven by the single motor 260. In the following, of the configuration for driving the movable blade 32 and the rollers 42 and 44 with the single motor 260, a part related to the driving of the movable blade 32 and the roller 42 is described. The roller 44 may be interlocked with the roller 42 to rotate together with the roller 42, for example.

For example, as illustrated in FIG. 8, the cutter unit 250 of the printer of this embodiment includes the motor 260, a first gear 261, a second gear 262, a third gear 263, a fourth gear 264, and a fifth gear 265. The first gear 261 is provided coaxially with a rotation shaft of the motor 260. The first gear 261 is caused to rotate by the rotation of the motor 260. The second gear 262, which is meshed with the first gear 261, is caused to rotate by the rotation of the first gear 261. The third gear 263, which is meshed with the second gear 262, is caused to rotate by the rotation of the second gear 262. The fourth gear 264 is provided on a rotation shaft of the roller 42. Furthermore, the fifth gear 265 is meshed with a gear part 32*a* provided on the movable blade 32.

According to the printer of this embodiment, it is possible to selectively perform an operation of causing the roller 42 to rotate or an operation of causing the movable blade 32 to vertically move by moving the position of the third gear 263.

Figure 9:
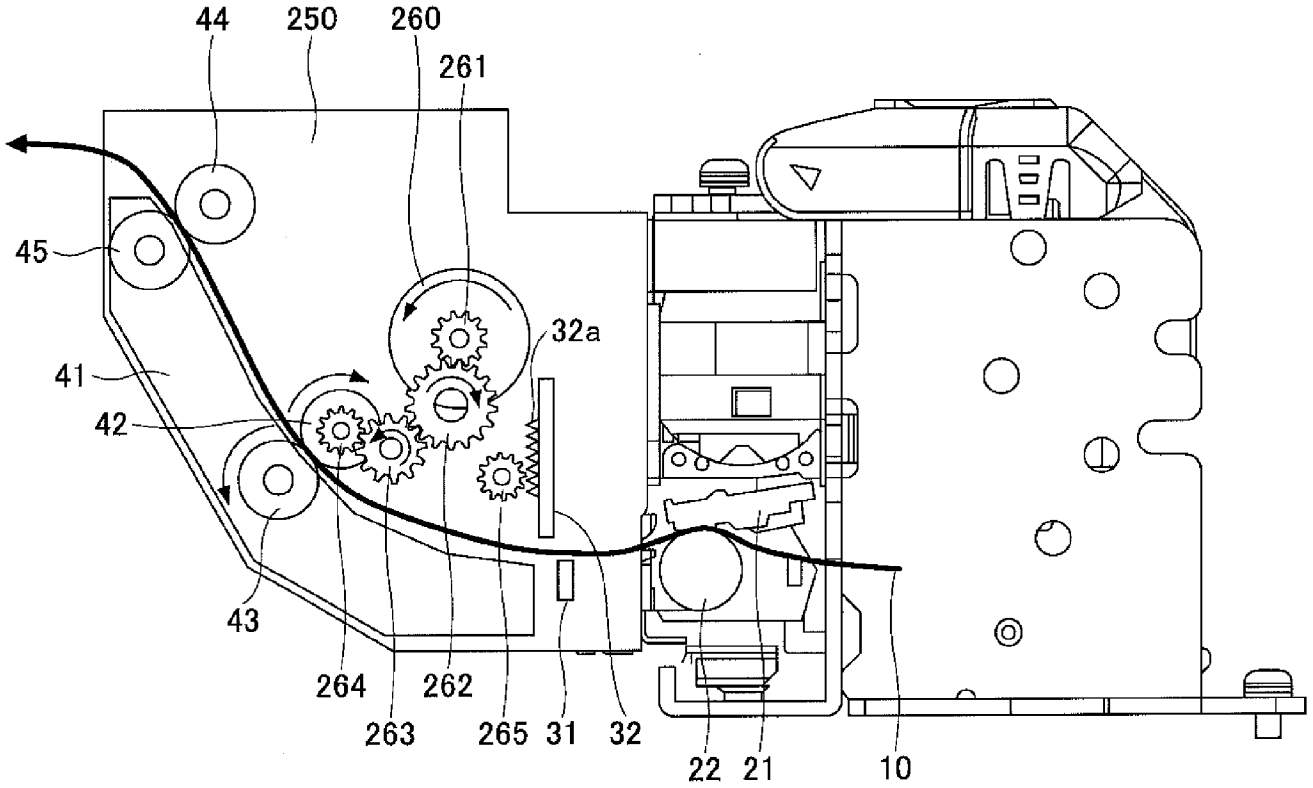
FIG. 9 is a diagram illustrating the printer according to the second embodiment.

For example, as illustrated in FIG. 9, the recording paper 10 may be conveyed by causing the roller 42 to rotate by causing the motor 260 to rotate with the third gear 263 moved to a position where the third gear 263 meshes with the fourth gear 264. That is, when the motor 260 is caused to rotate counterclockwise with the third gear 263 moved to a position where the third gear 263 meshes with the fourth gear 264, the first gear 261 also rotates counterclockwise. As a result, the second gear 262 rotates clockwise, the third gear 263 rotates counterclockwise, the fourth gear 264 rotates clockwise, and the roller 42 rotates clockwise. As a result of this rotation of the roller 42, it is possible to convey the recording paper 10.

Figure 10:
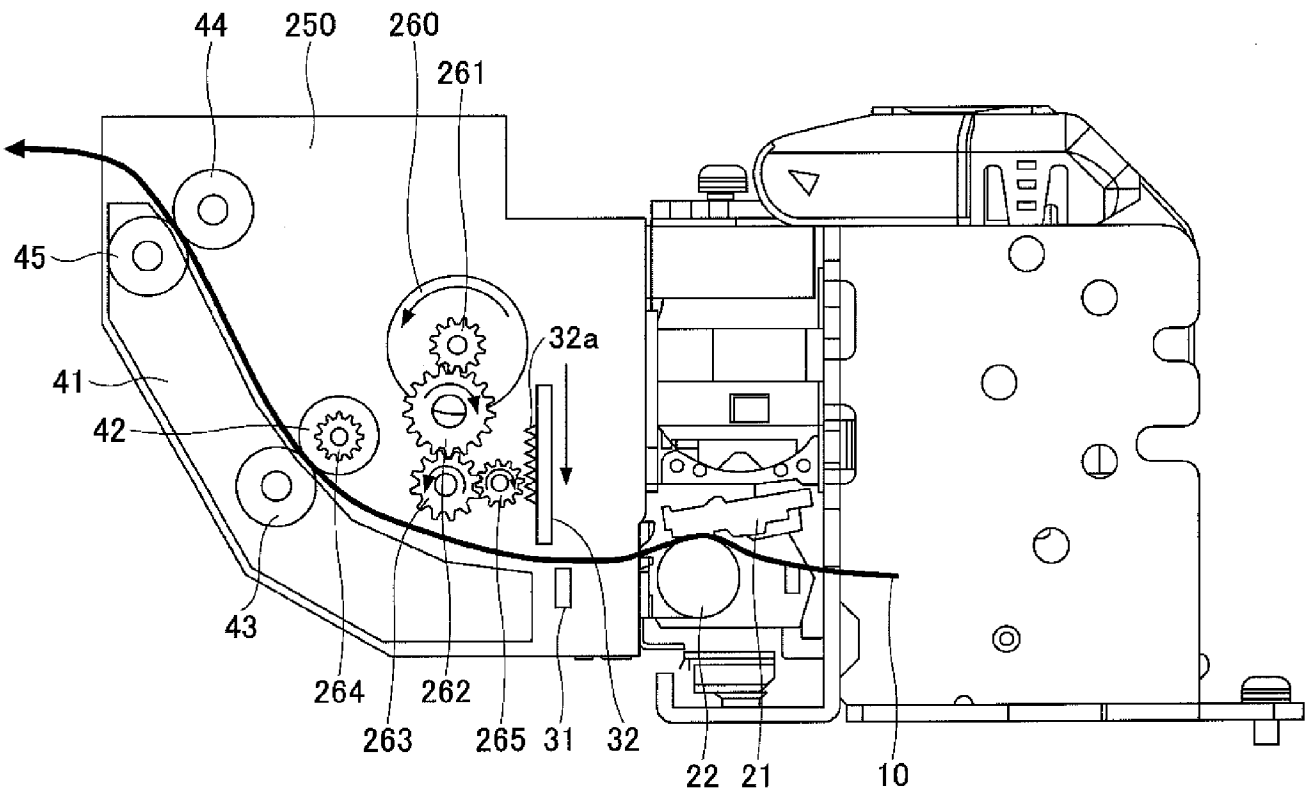
FIG. 10 is a diagram illustrating the printer according to the second embodiment.

Furthermore, as illustrated in FIG. 10, the recording paper 10 may be cut by causing the movable blade 32 to move downward by causing the motor 260 to rotate with the third gear 263 moved to a position where the third gear 263 meshes with the fifth gear 265. That is, when the motor 260 is caused to rotate counterclockwise with the third gear 263 moved to a position where the third gear 263 meshes with the fifth gear 265, the first gear 261 also rotates counterclockwise. As a result, the second gear 262 rotates clockwise, the third gear 263 rotates counterclockwise, the fifth gear 265 rotates clockwise, and the gear part 32*a* moves downward, so that the movable blade 32 moves downward. As a result, it is possible to cut the recording paper 10 with the fixed blade 31 and the movable blade 32.

Thus, according to the printer of this embodiment, it is possible to selectively perform an operation of causing the roller 42 to rotate or an operation of causing the movable blade 32 to move with a single motor. Accordingly, it is possible to further reduce the size and the cost of a printer.

Figure 11:
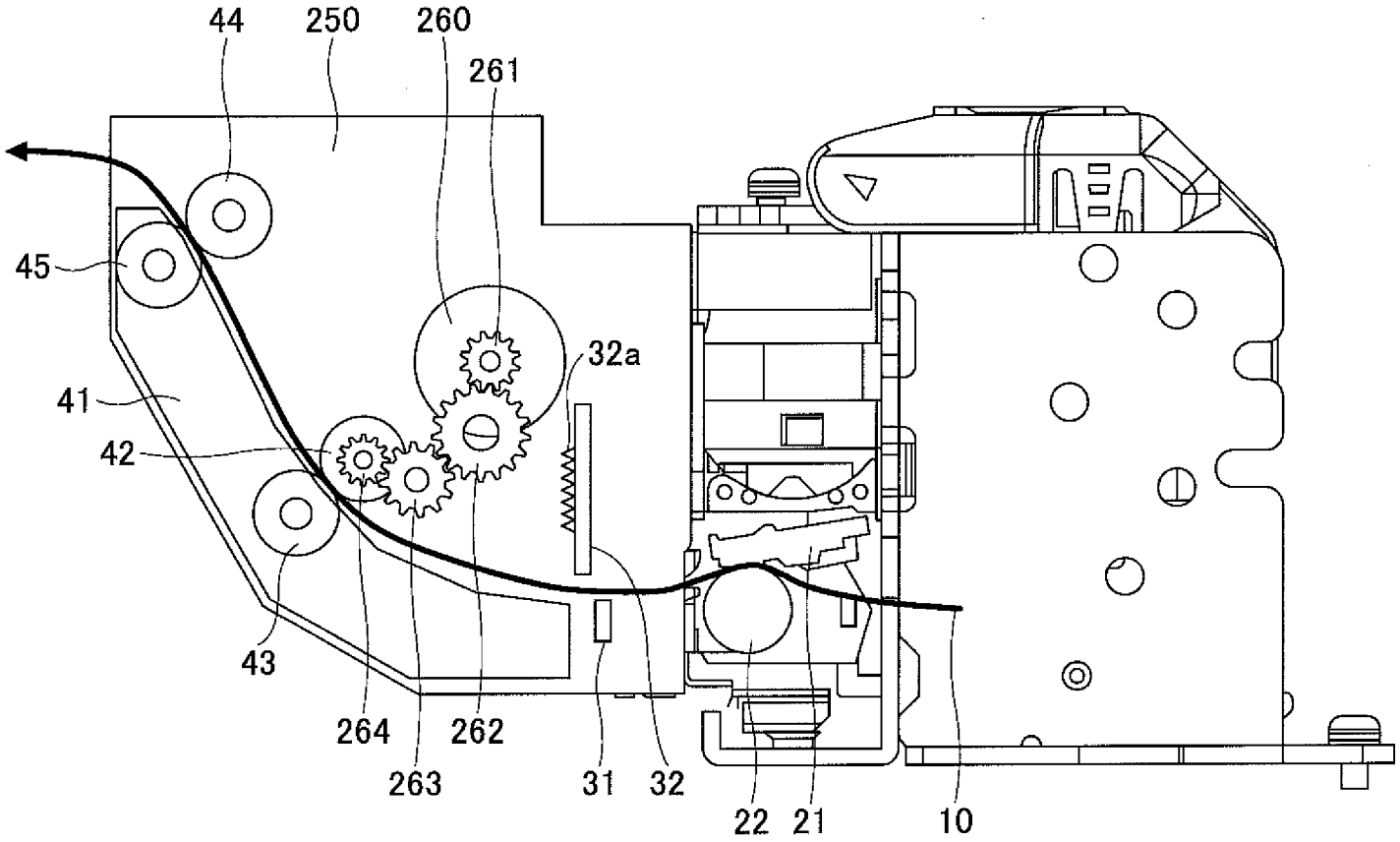
FIG. 11 is a diagram illustrating another printer according to the second embodiment.
Figure 12:
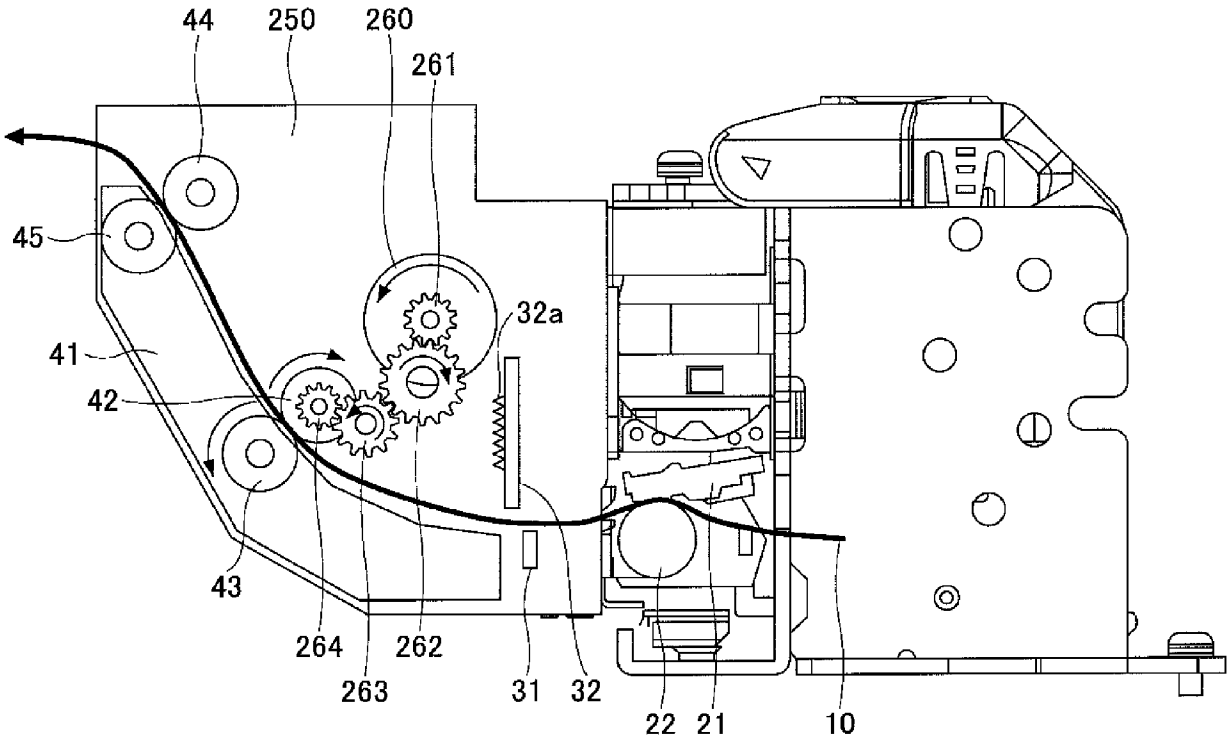
FIG. 12 is a diagram illustrating the other printer according to the second embodiment.
Figure 13:
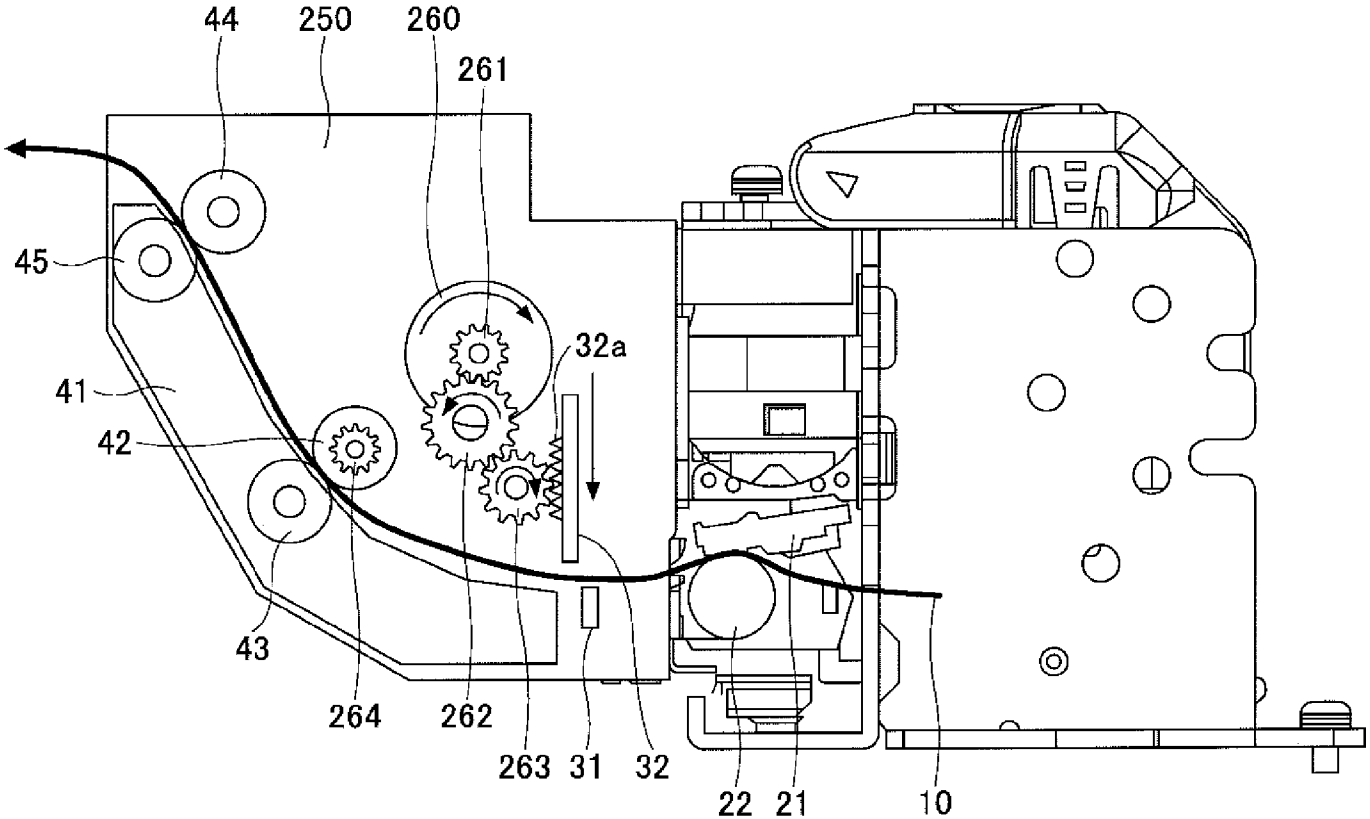
FIG. 13 is a diagram illustrating the other printer according to the second embodiment.

Furthermore, the printer according to this embodiment may omit the fifth gear 265 as illustrated in FIG. 11. In the case of conveying the recording paper 10 in the printer of this structure, as illustrated in FIG. 12, the motor 260 is caused to rotate counterclockwise with the third gear 263 moved to mesh with the fourth gear 264 the same as in FIG. 9. In the case of cutting the recording paper 10, the motor 260 is caused to rotate clockwise with the third gear 263 moved to mesh with the gear part 32*a*. By thus shifting the position of the third gear 263 and switching the rotation direction of the motor 260, it is possible to switch from one to the other of the operation of conveying the recording paper 10 and the operation of cutting the recording paper 10.

In other aspects than those described above, the second embodiment may be the same as the first embodiment.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A printer, comprising:

a printing part that includes a thermal head and a platen roller that are provided inside a frame of the printing part, the thermal head performing printing on a recording medium held between the thermal head and the platen roller;

a cutter part that includes a cutter provided inside a frame of the cutter part, the cutter cutting the recording medium subjected to the printing, wherein the frame of the cutter part is attached to the frame of the printing part so as to be rotatable about a rotation shaft relative to the frame of the printing part including the platen roller; and a presenter part configured to convey the recording medium subjected to the printing in the printing part through the cutter part, wherein a frame of the presenter part is attached to the frame of the cutter part and moves together with the frame of the cutter part in a case of rotating the frame of the cutter part about the rotation shaft.

2. The printer as claimed in claim 1, wherein the rotation shaft is a first rotation shaft, and the presenter part includes a conveyance path cover configured to rotate about a second rotation shaft different from the first rotation shaft so as to open and close the presenter part.

3. The printer as claimed in claim 1, wherein the cutter part and the presenter part are formed as a one-piece structure.

4. The printer as claimed in claim 3, wherein the one-piece structure of the cutter part and the presenter part includes a single motor, and a movable blade of the cutter is caused to move and a roller inside the frame of the presenter part is caused to rotate by the single motor.

5. The printer as claimed in claim 4, wherein the one-piece structure further includes a gear configured to transmit a rotation of the single motor, and an operation of causing the movable blade to move and an operation of causing the roller to rotate are switched by shifting a position of the gear.

6. The printer as claimed in claim 5, wherein the operation of causing the movable blade to move and the operation of causing the roller to rotate are switched by shifting the position of the gear and switching a rotation direction of the single motor.

7. The printer as claimed in claim 1, wherein a path through which the recording medium is conveyed is formed inside each of the frame of the cutter part and the frame of the presenter part, and the path formed inside the frame of the cutter part and the path formed inside the frame of the presenter part move together relative to the frame of the printer part in the case of rotating the frame of the cutter part about the rotation shaft.

8. A printer, comprising:

a printing part that includes a thermal head and a platen roller that are provided inside a frame of the printing part, the thermal head performing printing on a recording medium held between the thermal head and the platen roller; and a cutter unit rotatably supported on the frame of the printing part by a rotation shaft, wherein the cutter unit includes a cutter part configured to cut the recording medium subjected to the printing by the printing part; and a presenter part configured to convey the recording medium conveyed through the cutter part, wherein the cutter unit including the cutter part and the presenter part rotates relative to the frame of the printing part including the platen roller so as to open a conveyance path between the printing part and the cutter unit.

9. The printer as claimed in claim 8, wherein the rotation shaft is a first rotation shaft, and the presenter part includes a conveyance path cover configured to rotate about a second rotation shaft different from the first rotation shaft so as to open and close the presenter part.

10. The printer as claimed in claim 8, wherein the cutter unit includes a single motor, and a movable blade in the cutter part is caused to move and a roller in the presenter part is caused to rotate by the single motor.

11. The printer as claimed in claim 10, wherein the cutter unit further includes a gear configured to transmit a rotation of the single motor, and an operation of causing the movable blade to move and an operation of causing the roller to rotate are switched by shifting a position of the gear.

12. The printer as claimed in claim 11, wherein the operation of causing the movable blade to move and the operation of causing the roller to rotate are switched by shifting the position of the gear and switching a rotation direction of the single motor.

* * * * *